US007128446B2

(12) United States Patent
Vanden Eynden

(10) Patent No.: US 7,128,446 B2
(45) Date of Patent: Oct. 31, 2006

(54) LUMINAIRE REFLECTOR

(75) Inventor: James G. Vanden Eynden, Hamilton, OH (US)

(73) Assignee: LSI Industries, Inc., Cincinnati, OH (US)

( * ) Notice: Subject to any disclaimer, the term of this patent is extended or adjusted under 35 U.S.C. 154(b) by 270 days.

(21) Appl. No.: 10/660,317

(22) Filed: Sep. 11, 2003

(65) Prior Publication Data

US 2005/0057931 A1 Mar. 17, 2005

(51) Int. Cl.
*F21V 7/00* (2006.01)

(52) U.S. Cl. ..... 362/346; 362/348; 362/297

(58) Field of Classification Search ..... 362/297, 362/298, 300, 296, 346, 347, 348
See application file for complete search history.

(56) References Cited

U.S. PATENT DOCUMENTS 4,028,542 A * 6/1977 McReynolds, Jr. ..... 362/297
4,254,456 A * 3/1981 Grindle et al. ..... 362/300
6,464,378 B1 10/2002 Reed

* cited by examiner

*Primary Examiner*—John Anthony Ward
(74) *Attorney, Agent, or Firm*—Daniel F. Nesbitt; Hasse & Nesbitt LLC

(57) ABSTRACT

A luminaire for providing increased illumination and efficiency comprising a plurality of reflectors, lamps and electrically connected lamp sockets arranged such that the light reflected off of a reflector is reflected at a generally uniform angle and does not reflect off of any other reflector or lamp surface. The luminaire results in an increased light distribution pattern and greater operational efficiency.

25 Claims, 9 Drawing Sheets

HORIZONTAL FOOTCANDLES
SCALE: 1 INCH = 20 FT
LIGHT LOSS FACTOR = 1
TOTAL LUMENS = 36000
MOUNTING HEIGHT = 20 FT
ARM LENGTH = 0 FT
MAXIMUM CALCULATED VALUE = 2.9

LUMINAIRE REFLECTOR

FIELD OF THE INVENTION

This invention relates generally to luminaire reflectors and more particularly to luminaire reflectors used for a wide variety of lighting applications.

BACKGROUND OF THE INVENTION

Many luminaires incorporate reflectors to increase the efficiency of their light output. Reflectors can be formed in a variety of shapes and sizes and are typically designed and oriented to provide optimized light distribution for particular applications. Accordingly, they may be symmetrical or asymmetrical depending on the desired light output distribution. The most common reflector for a luminaire is a symmetrical reflector. Because the reflector surrounds the lamp to reflect the light, it is usually fashioned from a single piece of material or is fashioned from multiple pieces of material to constitute a single reflector.

As mentioned, a standard reflector for a luminaire is a symmetrical design. The reflector surrounds the lamp and reflects the light downward in a substantially round distribution pattern. Because the lamp is almost always placed within the volume defined by the reflector, the wide angle illumination of a lamp and reflector combination is limited to the light that is directly emitted from the lamp and/or is reflected by the reflector and then passes below the edge of the reflector or luminaire body without contacting any part of the luminaire. This limitation results in a relatively limited wide angle light distribution pattern below the luminaire. To an extent, this difficulty can be addressed by lowering the lamp within the reflector volume or raising the reflector with respect to the lamp. However, this can result in increased glare and eye strain. Additionally, in having a reflector that surrounds the lamp some of the light is reflected multiple times within the reflector thereby reducing the efficiency of the luminaire. Further, some of the light is reflected back through the lamp itself which can result in reduced lamp life and reduced efficiency.

While other reflectors have been designed specifically to provide wide angle lighting distribution patterns, they are subject to different design considerations and usually result in decreased light intensity in certain regions in order to maximize the light intensity in other desired areas. While this provides an improved luminaire for specific lighting applications, such luminaires have limited utility for other lighting applications.

Thus, there is a substantial need for a reflector that can increase luminaire efficiency while providing increased wide angle lighting.

SUMMARY OF THE INVENTION

The present invention is a reflector that provides increased wide angle lighting over standard and specialized luminaires through the use of individual reflector elements that do not physically enclose the lamp but are disposed around the lamp. More specifically, the reflector elements are of such shape and location that substantially none of the light reflected by any reflector element is reflected back toward the center of the luminaire; instead all of the reflected light is reflected away from the luminaire as part of a wide angle distribution pattern.

In the preferred embodiment, the luminaire has four identical reflectors symmetrically disposed around a central lamp. The cross-sections of the reflectors are curves and are shaped so that all of the reflected light is reflected at substantially the same wide angle. Accordingly, the light that is not reflected illuminates the area below the luminaire while the reflected light solely illuminates outlying areas at the designated wide angle. Together, the illumination patterns in the preferred embodiment are designed to create a substantially round pattern. In the preferred embodiment the wide angle is seventy degrees from nadir, thereby cutting off further wide angle illumination to prevent glare and eye strain and reducing the number of poles and fixtures otherwise required. In its preferred embodiment the reflectors are comprised of curves that are generally parabolic along the vertical plane and are generally elliptical along the horizontal plane.

The shape of the reflectors can be changed to alter the angle at which light is reflected. The reflectors could also be asymmetrically disposed around the lamp to create a non-uniform illumination pattern. Also, if desired, a lens could be used beneath and/or around the lamp and reflectors to focus the emitted light and/or protect the lamp and reflectors. In the preferred embodiment a 400 watt metal halide high intensity discharge (HID) lamp is used, but other types of lamp could be substituted in its place for different applications. For HID lamps, external control equipment is commonly used and is stored within a ballast box located within the luminaire or remotely mounted, and electrically connected to the luminaire. The reflectors can be formed by a variety of methods used to form reflectors including but not limited to using a sheet metal hydroform press, a plastic injection molding and vapor deposition process, a die cast for zinc or rapid tooling technologies.

By virtue of the foregoing, there is thus provided a luminaire that provides increased angle illumination with fewer luminaires required to illuminate an area. Additionally, the design of the reflectors provides increased efficiency over standard luminaires as the result of the minimized internal reflections, thereby providing greater illumination and permitting the use of lower wattage lamps for equivalent levels of light, thereby reducing usage of electricity while preserving usable light output. These and other objects and advantages of the present invention shall become apparent from the accompanying drawings and the detailed description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE DRAWINGS

Figure 1:
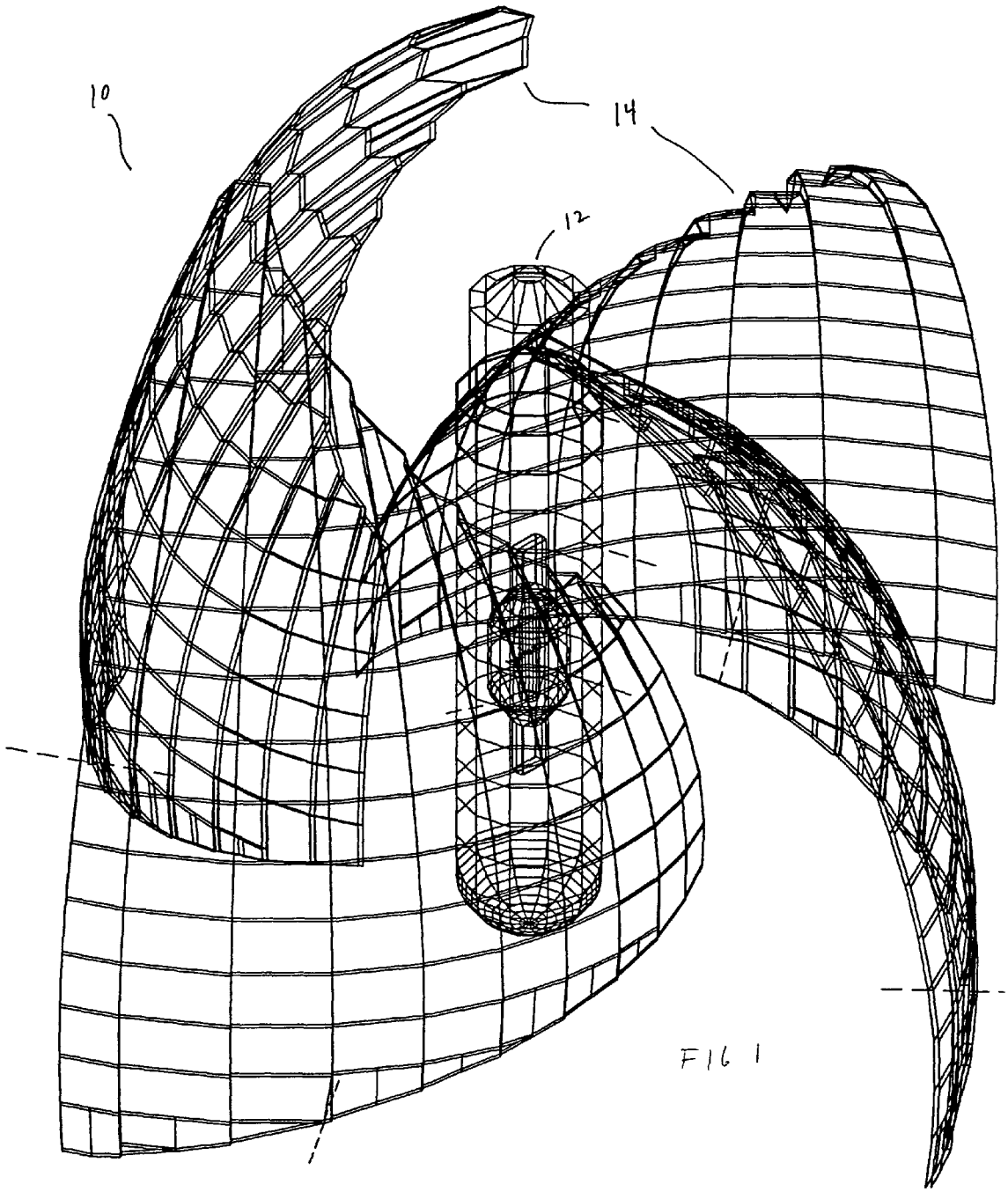
FIG. 1 is an elevation perspective of the reflectors and lamp of the preferred embodiment in accordance with the principles of the present invention.
Figure 2:
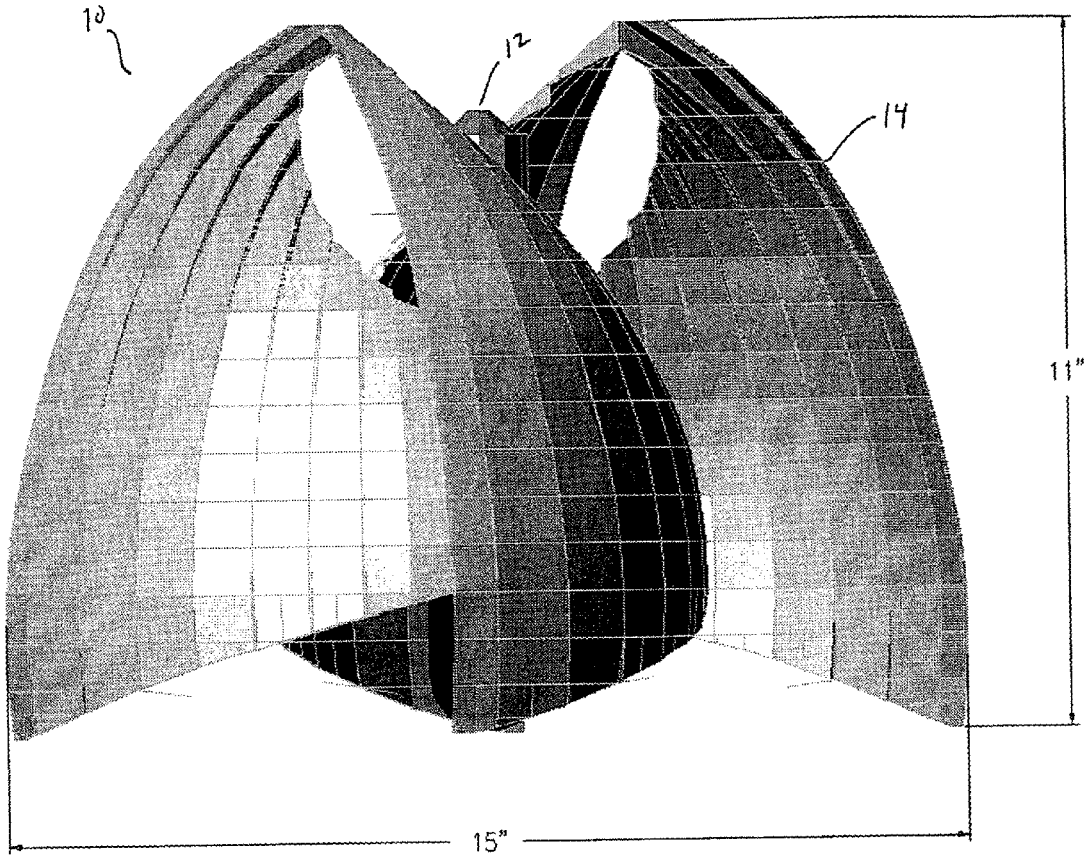
FIG. 2 is a detailed side perspective of the reflectors and lamp of the preferred embodiment.
Figure 3:
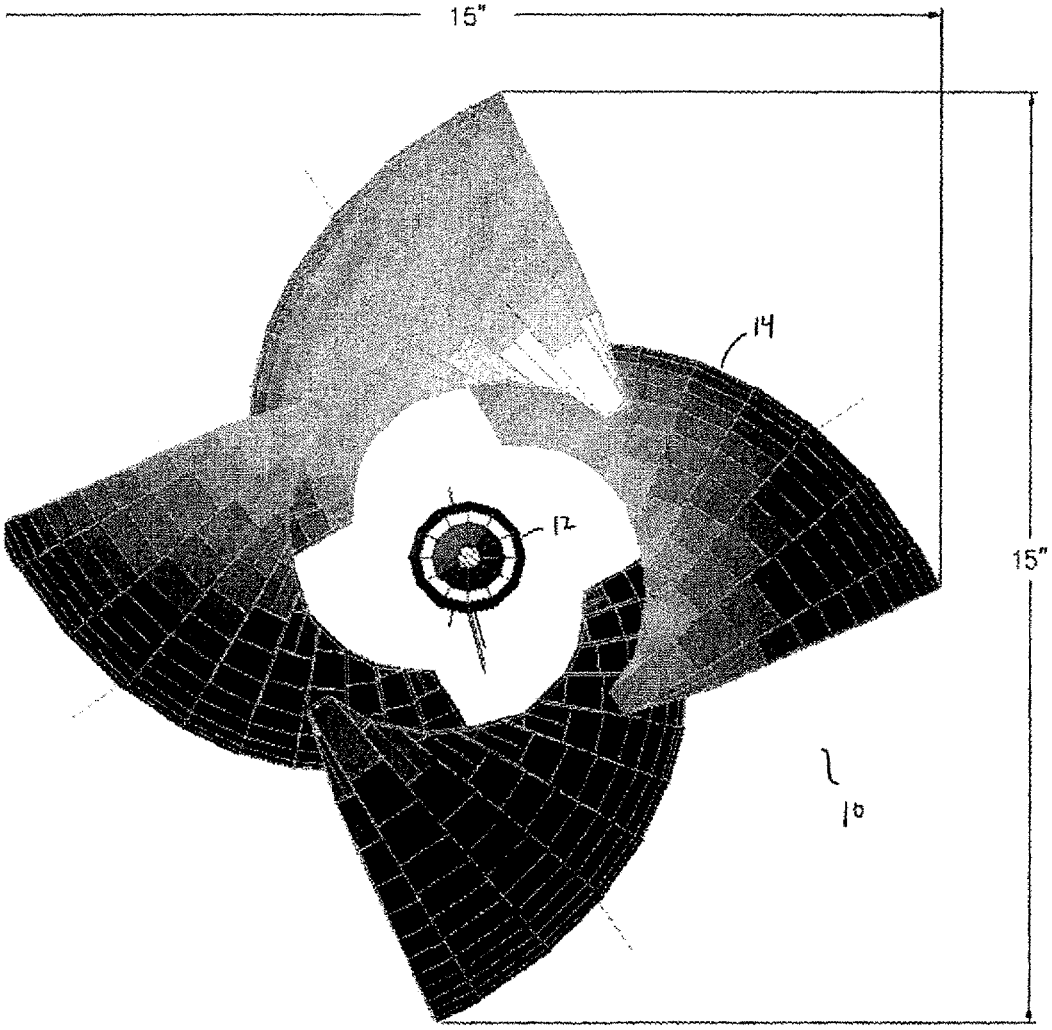
FIG. 3 is a detailed top perspective of the reflectors and lamp of the preferred embodiment.

The luminaire 10, as depicted in FIGS. 1, 2 and 3, comprises a lamp 12 surrounded by four reflectors 14. The four reflectors 14 shown in the preferred embodiment are separate elements that are sections of curves that are generally parabolically shaped in the vertical plane and generally elliptically shaped in the horizontal plane. The reflectors 14 are symmetrically oriented around the lamp such that all of the light output that is not initially directed below the bottom edges of the reflectors is reflected from the reflectors 14 at a generally single angle. In the preferred embodiment, the dimensions from the furthest outside point of one reflector to the furthest outside point of the reflector that is opposite such first reflector is fifteen inches and the height of each reflector is approximately eleven inches.

Figure 4A:
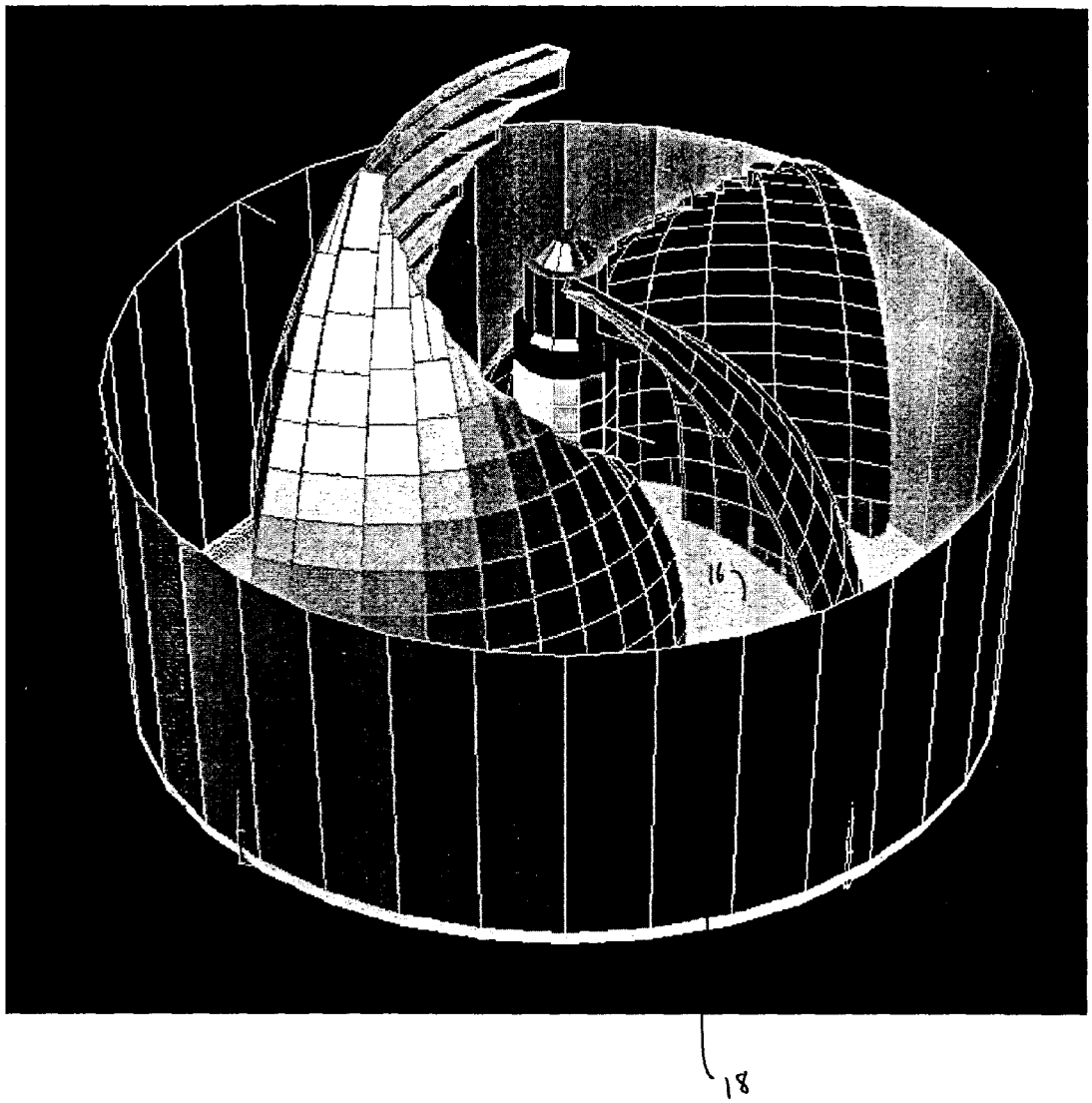
FIGS. 4A and 4B are elevated and side perspectives, respectively, of the preferred embodiment of the luminaire.
Figure 4B:
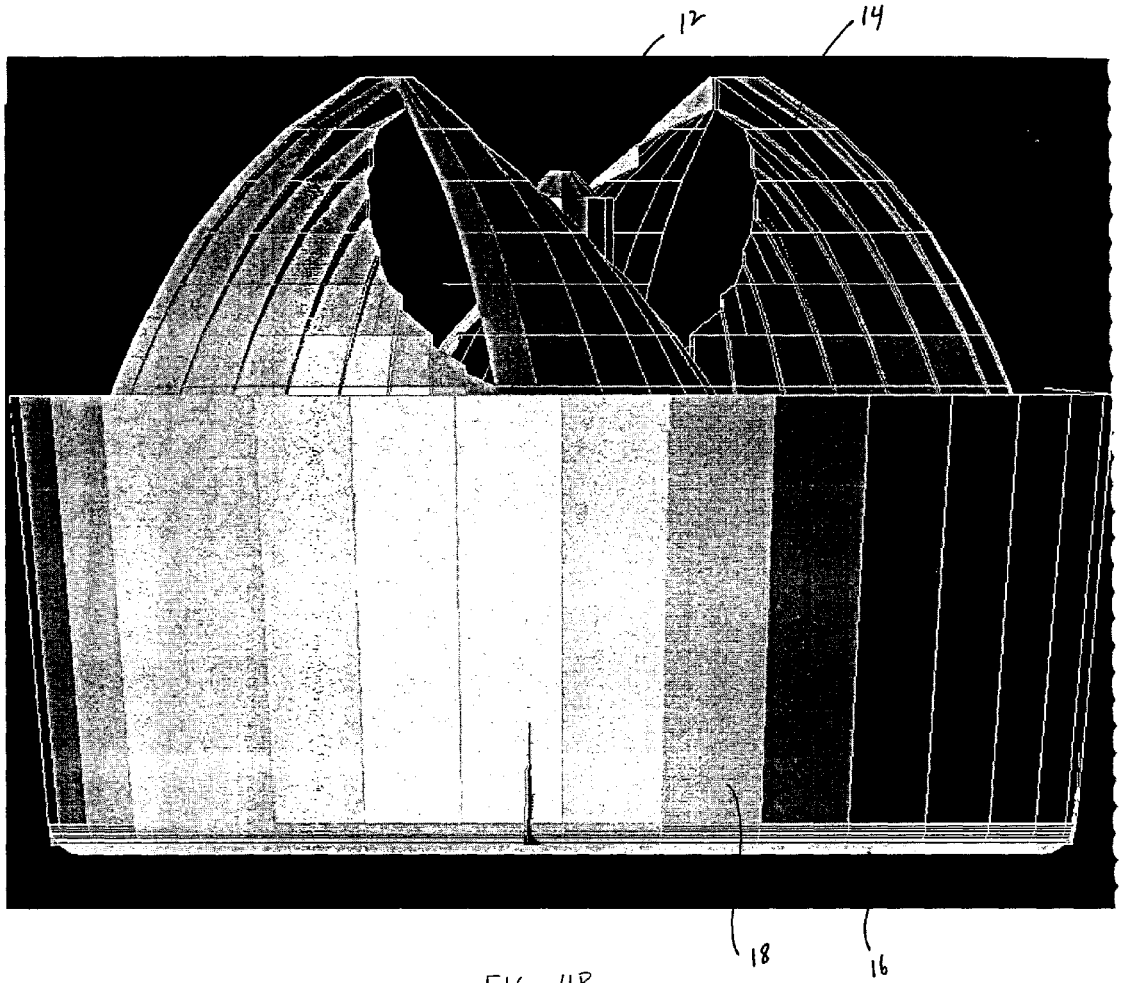

The reflectors 14 can be secured in position by a variety of methods. FIGS. 4A and 4B show the reflectors 14 being held in place by sitting on top of the lens 16 and centered around lamp 12 inside of the lens or luminaire body 18. Examples of other ways the reflectors could also be held in place include joining them to an overhead frame via fastening means, by attaching them to a frame via fastening means, attaching them directly to the lens with adhesive means, using wire form rings attached to an overhead frame, using a single wire form ring on a neutral axis of the reflectors or other fastening means.

Figure 5:
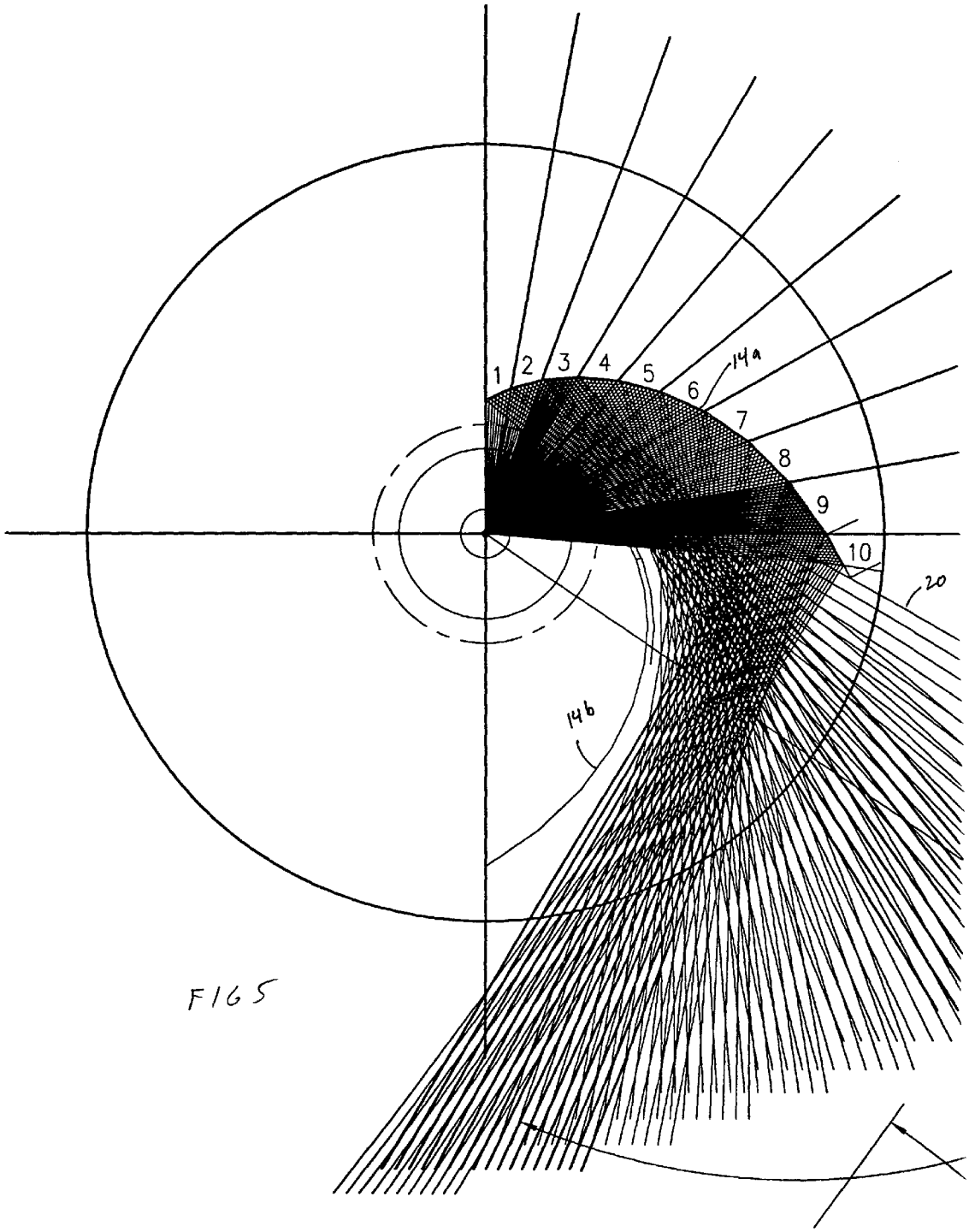
FIG. 5 is a diagram showing the light reflection pattern from one of the reflectors for the preferred embodiment of the luminaire.

The light reflection pattern 20 is depicted in FIG. 5. A first reflector 14*a* and second reflector 14*b* are shown with a light reflection pattern 20 being shown from the first reflector 14*a*. The light reflected from the inner portion of the first reflector 14*a* passes near the end of the reflector 14*a* and light reflected from the outer portion of the reflector 14*a* passes near the back of the second reflector 14*b*, however, substantially none of the reflected light is reflected again by either the first reflector 14*a* or the second reflector 14*b*.

Figure 6:
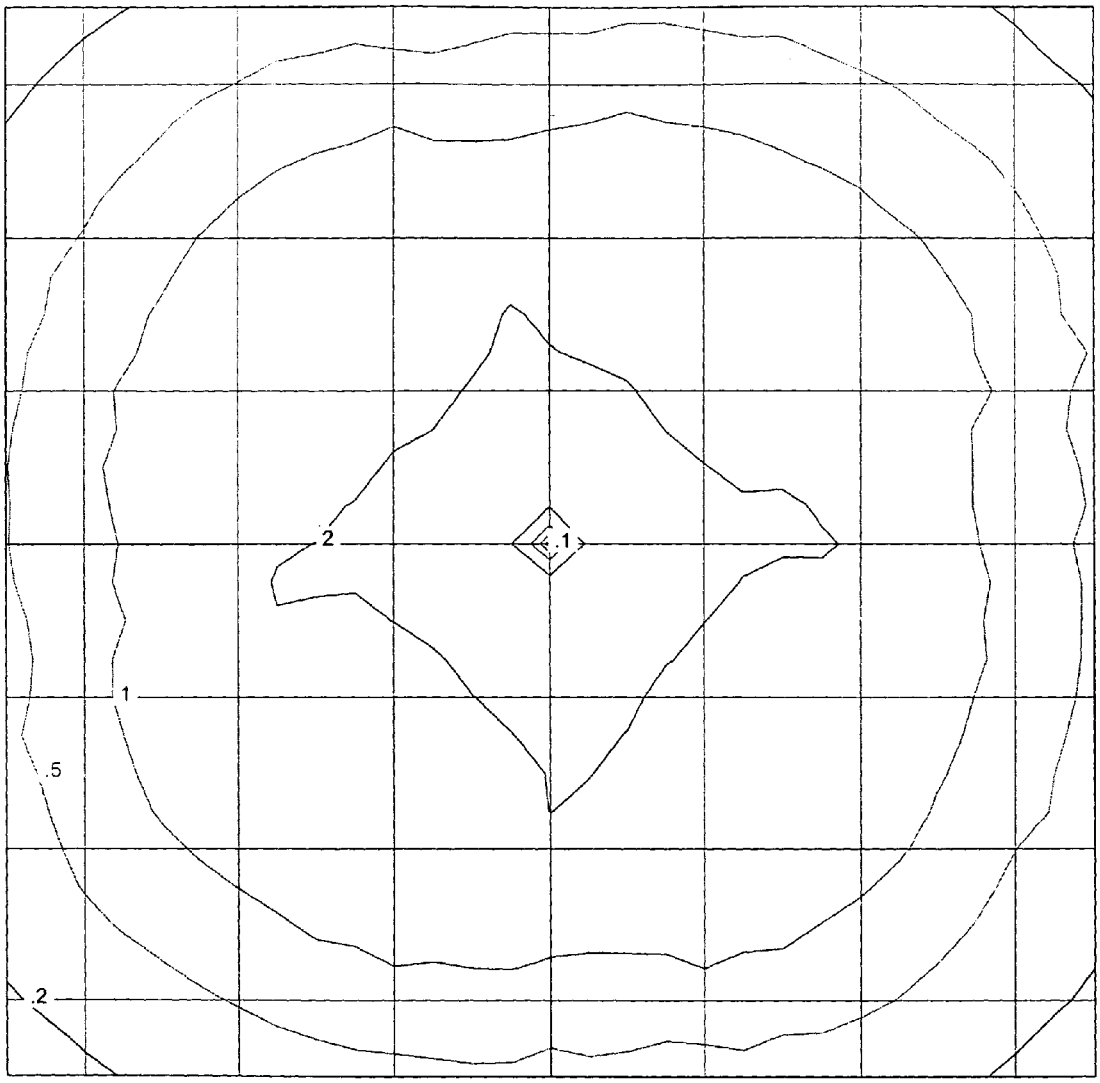
FIG. 6 is a diagram showing the light distribution pattern for the preferred embodiment of the luminaire.

The photometric report for the preferred luminaire is shown in FIG. 6. In this particular report the luminaire 10 was mounted at a height of twenty feet and this report shows the horizontal illumination on the ground. Qualitatively, the preferred embodiment of the luminaire 10 produces a widespread, substantially round light pattern. The light intensity distribution could easily be modified by adjusting either the shape, size, position and/or number of the reflectors 14.

Figure 7:
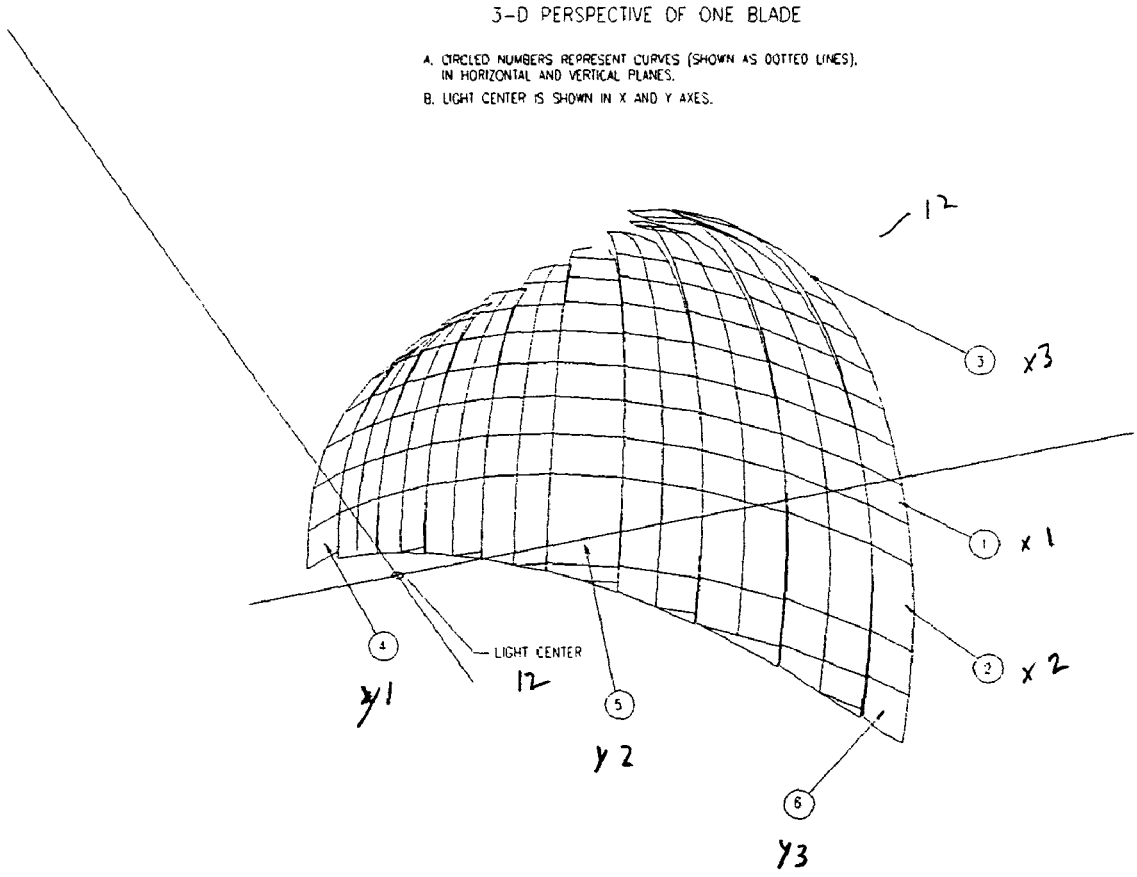
FIG. 7 is a perspective of a single reflector blade of the preferred embodiment.
Figure 8:
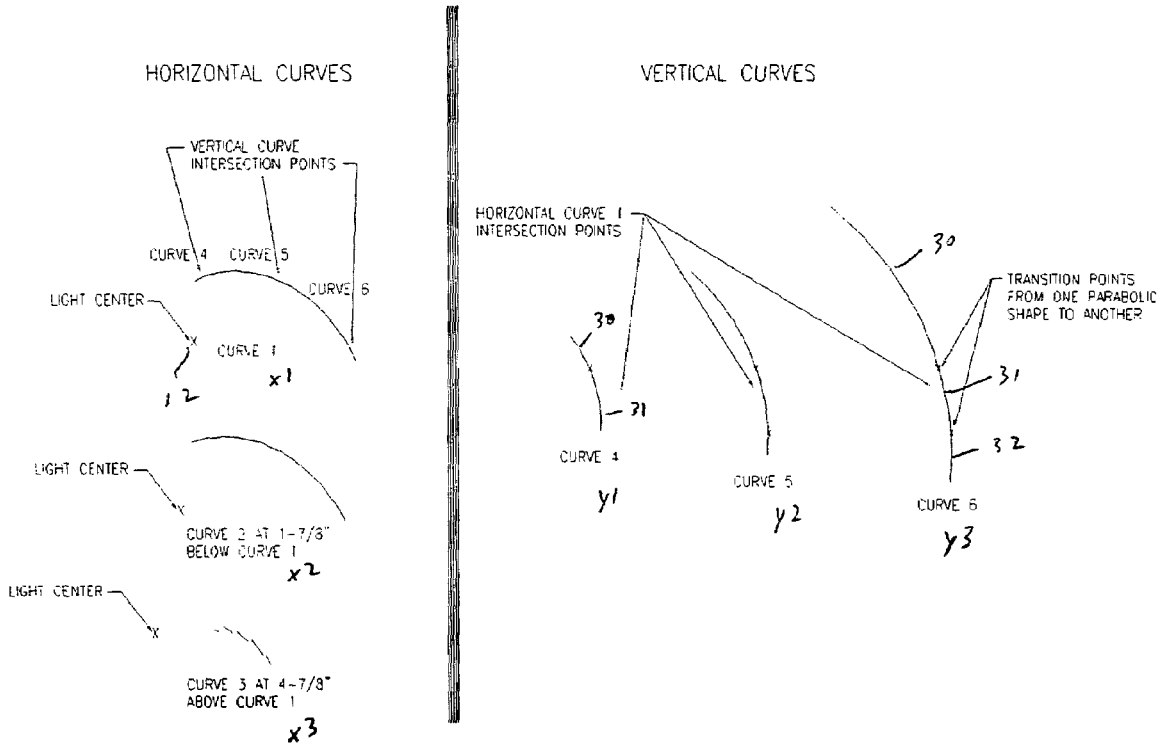
FIG. 8 is a diagram showing specific curves corresponding to cross-sections of the reflector blade represented in FIG. 7.

FIGS. 7 and 8 show the specific curves that comprise a single reflector 14 in the preferred embodiment of the luminaire 10. The lamp 12 is represented as a single point referred to as the light center. The curves x1, x2 and x3 in the horizontal plane and curves y1, y2 and y3 in the vertical plane are shown as part of the reflector in FIG. 7 and shown as individual curves in FIG. 8. Curves y2 and y3 each are comprised of three different generally parabolic shapes 30, 31 and 32 and curve y1 is comprised of two generally parabolic segments 30 and 31.

While the present invention has been illustrated by description of an embodiment which has been described in detail, it is not the intention of the applicant to restrict or in any way limit the scope of the appended claims to such detail. Additional advantages will readily appear to those skilled in the art. Thus, the invention in its broadest aspects is not limited to the specific details, representative apparatus and method, and illustrative examples shown and described. Accordingly, departures may be made from the details without departing from the spirit or scope of applicant's general inventive concept.

What is claimed is:

1. A reflector for a luminaire having a light source securable therein and openings through which light is emitted, comprising:

a plurality of reflector elements, each having an asymmetric shape, disposed around said light source in a manner substantially surrounding said light source in the area generally adjacent to the lowest light emitting point of said light source and continuing to the area generally adjacent to the highest light emitting point or top of said light source and wherein said light source is not physically enclosed by said reflector elements.

2. The reflector of claim 1 wherein said reflector elements are shaped and positioned such that substantially all of the light reflected from said reflectors is reflected at substantially the same angle from nadir and does not reflect off any other reflector elements.

3. The reflector of claim 2 wherein there are four reflector elements placed in locations symmetrically arranged in ninety degree increments around said light source.

4. The reflector of claim 2 wherein said reflector elements are placed in locations symmetrically around said light source.

5. The reflector of claim 2 wherein the reflection at said angle is approximately a seventy degree angle from nadir.

6. The reflector of claim 1 wherein said reflector elements are shaped and positioned such that light reflected from said reflector elements is reflected at varying angles from nadir.

7. The reflector of claim 6 wherein said reflector elements are placed in locations asymmetrically around said light source.

8. The reflector of claim 1 wherein said reflector elements are held in place with a lens surrounding at least a portion of said reflector.

9. The reflector of claim 1 wherein said reflector elements have cross-sectional shapes that are generally parabolic in the vertical plane and generally elliptical in the horizontal plane.

10. The reflector of claim 1 wherein said reflector elements have cross-sectional shapes that are generally elliptical in the vertical plane and generally parabolic in the horizontal plane.

11. The reflector of claim 1 wherein said reflector elements have a plurality of cross-sections with generally parabolic shapes of different sizes in the vertical planes and generally elliptical shapes of different sizes in the horizontal planes.

12. The reflector of claim 1 wherein said reflector elements have a plurality of cross-sections with generally elliptical shapes of different sizes in the vertical planes and generally parabolic shapes of different sizes in the horizontal planes.

13. The reflector of claim 1 wherein each reflector element as a bottom edge, and wherein all of the light output from the light source that is not initially directed below the bottom edges of the reflector elements, is reflected by the plurality of reflector elements.

14. A reflector assembly positionable within a luminaire that has a centrally-positioned light source, the reflector assembly consisting of at least a first and a second reflector element, each reflector element having:

a. a bottom edge, b. a front surface that reflects light emitted by the light source, and c. a back surface, wherein the positioned first and second reflector elements are positionable to surround the light source, wherein the front surface of the first reflector element and the back surface of the second reflector element have a separation therebetween, through which emitted light above the horizontal bottom opening that reflects from the front surface of the first reflector element can pass.

15. The reflector of claim 14 wherein said reflector elements are shaped and positioned such that substantially all of the light reflected from the front surface of the at least first and second reflector elements is reflected at substantially the same angle from nadir.

16. The reflector of claim 14 wherein the at least first and second reflector elements have a cross-sectional shape that is generally parabolic in the vertical plane and generally elliptical in the horizontal plane.

17. The reflector of claim 14 wherein the at least first and second reflector elements comprise four reflector elements symmetrically arranged in ninety degree increments around the light source.

18. The reflector of claim 14 wherein substantially none of the reflected light is reflected again by either the first reflector element or the second reflector element.

19. The reflector of claim 14 wherein the reflector elements have an asymmetrical shape.

20. A reflector assembly positionable within a luminaire that has a centrally-positioned light source, the reflector assembly comprising of a plurality of reflector elements arranged around a center, each reflector element having a front reflective surface and a back surface, an inner portion that is disposed a first radial distance from the center, and an outer portion disposed a second radial distance from the center that is greater than the first radial distance, wherein the front surface of the outer portion of the first reflector surface faces toward the back surface of the inner portion of the second reflector element across an opening there between, and wherein emitted light from the center of the reflector assembly that reflects off of the front surface of the first reflector element, passes through the opening between the outer portion of the first reflector element and the back surface of the second reflector element.

21. The reflector of claim 20 wherein said reflector elements are shaped and positioned such that substantially all of the light reflected from the front surface of the plurality of reflector elements is reflected at substantially the same angle from nadir.

22. The reflector of claim 20 wherein the plurality of reflector elements have a cross-sectional shape that is generally parabolic in the vertical plane and generally elliptical in the horizontal plane.

23. The reflector of claim 20 wherein there are four reflector elements symmetrically arranged in ninety degree increments around the light source.

24. The reflector of claim 20 wherein substantially none of the reflected light is reflected again by either the first reflector element or the second reflector element.

25. The reflector of claim 20 wherein the reflector elements have an asymmetrical shape.

* * * * *